US007722432B2

(12) United States Patent
Wood et al.

(10) Patent No.: US 7,722,432 B2
(45) **Date of Patent: *May 25, 2010**

(54) METHOD FOR MOLDING LOFTED MATERIAL WITH DECORATIVE SUPPORT PANEL AND GARMENT MADE

(75) Inventors: Thomas S. Wood, Mooresville, NC (US); Roger D. Warren, Claremont, NC (US)

(73) Assignee: HBI Branded Apparel Enterprises, LLC, Winston-Salem, NC (US)

( * ) Notice: Subject to any disclaimer, the term of this patent is extended or adjusted under 35 U.S.C. 154(b) by 1057 days.

This patent is subject to a terminal disclaimer.

(21) Appl. No.: 11/281,664

(22) Filed: Nov. 17, 2005

(65) Prior Publication Data

US 2006/0094333 A1 May 4, 2006

Related U.S. Application Data

(63) Continuation-in-part of application No. 11/152,859, filed on Jun. 15, 2005, now Pat. No. 7,556,553, which is a continuation-in-part of application No. 11/150,985, filed on Jun. 13, 2005, which is a continuation-in-part of application No. 10/631,474, filed on Jul. 31, 2003, now abandoned.

(51) Int. Cl.
*A41C 3/00* (2006.01)

(52) U.S. Cl. ..... 450/39; 450/92; 450/93

(58) Field of Classification Search ..... 450/39, 450/92, 93, 54–58
See application file for complete search history.

(56) References Cited

U.S. PATENT DOCUMENTS 2,190,807 A 2/1940 Steinberger
2,609,539 A 9/1952 Shearer
3,021,845 A 2/1962 Smith
3,058,154 A 10/1962 Howard et al.
3,101,717 A 8/1963 Korman
3,167,816 A 2/1965 Howard et al.
3,266,495 A 8/1966 Sachs
3,320,346 A 5/1967 Galitzki et al.
3,331,906 A 7/1967 Adams
3,399,678 A 9/1968 Faron
3,464,418 A 9/1969 Silverman
3,527,858 A 9/1970 Braxton et al.

(Continued)

FOREIGN PATENT DOCUMENTS

EP 1 440 626 7/2004

(Continued)

*Primary Examiner*—Gloria Hale
(74) *Attorney, Agent, or Firm*—Womble Carlyle Sandridge & Rice PLLC

(57) ABSTRACT

A method for making a garment having a lofted assembly having an outer support layer and garment so produced are provided. The method includes the steps of positioning a support fabric on a lofted material; sewing the support fabric to the lofted material to form a lofted assembly; positioning the lofted assembly in a molding apparatus having at least a first mold and a second mold, closing together the first mold and the second mold thereby sandwiching the lofted assembly therebetween and while maintaining a uniform preset gap between said first mold and the second mold so that the inherent loft characteristics of the lofted assembly are substantially preserved after pressure and/or heat are applied.

16 Claims, 6 Drawing Sheets

U.S. PATENT DOCUMENTS 3,799,174 A 3/1974 Howard
3,799,721 A 3/1974 Howard
3,799,727 A 3/1974 Howard
3,799,728 A 3/1974 Howard
3,880,561 A 4/1975 Ferro
3,891,378 A 6/1975 Belmuth et al.
3,934,593 A * 1/1976 Mellinger ..... 450/56
3,947,207 A 3/1976 Magidson et al.
3,962,392 A 6/1976 Conner, Jr.
3,981,670 A 9/1976 Levy
4,008,029 A 2/1977 Shokite
4,013,750 A 3/1977 Magidson et al.
4,025,597 A 5/1977 Sawamoto
4,080,416 A 3/1978 Howard
4,127,374 A 11/1978 Ammeraal
4,143,662 A * 3/1979 Fisher ..... 450/53
4,162,885 A 7/1979 Asel
4,172,002 A 10/1979 Gluckin
4,244,249 A 1/1981 DiTullio
4,250,137 A 2/1981 Riedler
4,284,400 A 8/1981 Kaspar et al.
4,372,321 A * 2/1983 Robinson ..... 450/39
4,645,629 A 2/1987 Stern
5,098,330 A 3/1992 Greenberg
5,447,462 A * 9/1995 Smith et al. ..... 450/122
6,083,080 A 7/2000 Lawson et al.
6,165,047 A 12/2000 Scott et al.
6,213,841 B1 4/2001 Kuo
6,306,006 B1 10/2001 Cheng
6,398,620 B1 * 6/2002 Huang ..... 450/57
6,406,352 B1 6/2002 Cheng
6,409,865 B1 6/2002 Yates
6,425,800 B1 7/2002 Huang
6,439,959 B1 8/2002 Magrone et al.
6,796,876 B2 9/2004 Luk
6,805,610 B2 10/2004 Luk
6,805,611 B2 10/2004 Luk
6,805,612 B1 10/2004 Luk
6,811,464 B2 11/2004 Li
6,837,772 B1 1/2005 Luk
6,878,033 B2 * 4/2005 Luk ..... 450/39
6,881,123 B1 4/2005 Klakauskas
2002/0002023 A1 1/2002 Nakanishi
2002/0151239 A1 10/2002 Aerts
2003/0181129 A1 9/2003 Getman
2004/0224604 A1 11/2004 Luk
2004/0224606 A1 11/2004 Lin

FOREIGN PATENT DOCUMENTS

JP 2001-234402 8/2001
JP 2002-088523 3/2002
JP 2002-155403 5/2002
WO WO2005/012614 A2 2/2005

* cited by examiner

METHOD FOR MOLDING LOFTED MATERIAL WITH DECORATIVE SUPPORT PANEL AND GARMENT MADE

RELATED APPLICATION

This application is a continuation-in-part of application Ser. No. 11/152,859 filed on Jun. 15, 2005 now U.S. Pat. No. 7,556,553; which is a continuation-in-part of application Ser. No. 11/150,985 filed on Jun. 13, 2005; which is a continuation-in-part of U.S. application Ser. No. 10/631,474, filed on Jul. 31, 2003 now abandoned.

BACKGROUND OF THE INVENTION

1. Field of the Invention

The present invention relates to a method for molding garments and the garments made therefrom. More particularly, the present invention relates to a method for molding a lofted material having a sewn decorative support panel, and the resultant garment.

2. Description of the Prior Art

Various methods and mechanisms for molding different types and assemblies of material have been developed and are known. For example, U.S. Pat. No. 3,464,418 provides an apparatus and method for making brassiere pads from bonded non-woven fibrous batting material, U.S. Pat. No. 4,025,597 provides a method of making a brassiere cup from a soft fibrous board material, U.S. Pat. No. 4,080,416 provides a method for making multi-layered seamless brassiere pads, and U.S. Pat. No. 4,250,137 provides a process for preparing breast pads or fronts such that the pads are centrally soft and peripherally firmer.

Notwithstanding that which is known, there remains a continuing need for improved methods for molding a lofted material having a laminated support layer to provide a three dimensional shape thereto without compromising the loft characteristics associated with such material. Problems heretofore associated with various processes of molding a lofted material include at least the following: (1) thinning of material at points of increased pressure or applied heat, or both, such as for example, the apex of a bra cup or pad, (2) requiring relatively complicated or additional structural elements, or both to facilitate a desired result, for example, spacer devices or vacuum systems, and (3) requiring that heat, pressure or both be avoided at relatively substantial portions of the material being molded, which can complicate the molding process.

SUMMARY OF THE INVENTION

It is an object of the present invention to provide a method for molding a lofted assembly having an outer laminated support layer.

It is another object of the present invention to provide a garment that is made from a lofted material that has a outer laminated support layer that is molded to maintain the loft characteristics of such lofted material and the support layer.

It is yet another object of the present invention to provide a garment that is molded from a lofted material that has an outer laminated support layer that is a decorative outer layer that is sewn to the lofted material.

It is still yet another object of the present invention to provide a brassiere having molded breast cups that are made from a lofted assembly having a lofted material and an outer laminated synthetic support layer that is a decorative panel sewn or attached to the lofted material to provide support for average to large sized brassieres.

These and other objects and advantages of the present invention are achieved by a molding apparatus with at least a first die or mold with a projecting element and a first level portion, and a second die or mold with a recessed element and a second level portion. The projecting element and the recessed element are formed such that when the first level portion of the first mold and the second level portion of the second mold are brought into relatively close relation, a uniform preset distance or gap is created between the projecting element and the recessed element. The gap is preferably adjustable to accommodate the loft of different materials. The first mold and second mold each are preferably selectively and/or independently heatable, and are configured, as appropriate, to facilitate the following material molding method.

The method for molding the lofted material essentially comprises the steps of first sewing a pre-cut support layer in a pre-determined position on a piece of lofted material to form a lofted assembly and positioning the lofted assembly in the molding apparatus. Then, closing the first mold in relation to the second mold, or vice-versa, sandwiching the lofted assembly therebetween such that the portion of the lofted assembly situated between the first and second level portions is compressed and the portion of the lofted assembly situated between the projecting element and recessed element is compressed only to the extent desired or not at all. The extent of compression being adjustable. Following this closing step pressure and/or heat as appropriate is applied for the desired molding result. The resulting molded lofted assembly preferably provides a balance of comfort, support, durability and aesthetic appeal.

BRIEF DESCRIPTION OF THE DRAWINGS

Other and further objects, advantages and features of the present invention will be understood by reference to the following specification in conjunction with the accompanying drawings, in which like reference characters denote like elements of structure.

DETAILED DESCRIPTION OF THE INVENTION

Figure 1:
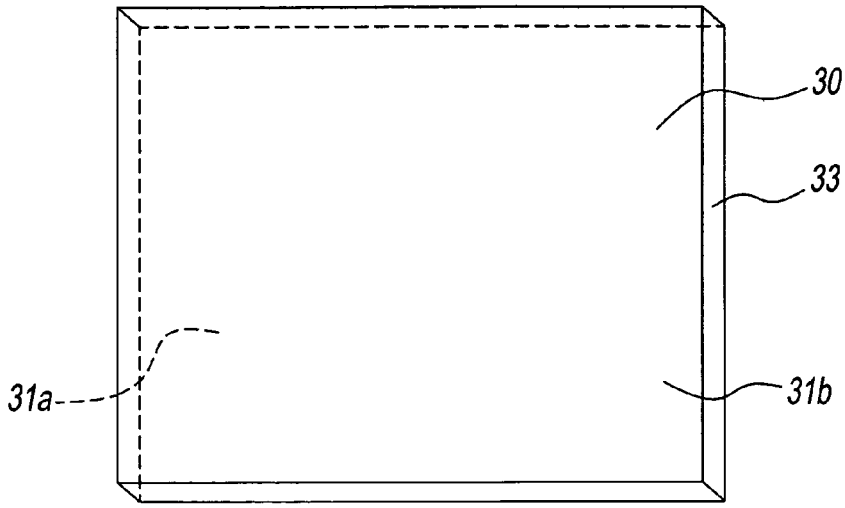
FIG. 1 is a perspective view of the lofted material that is to be molded in accordance with an illustrative embodiment of the present invention.

Referring to the drawings and, in particular to FIG. 1, there is shown an illustrative embodiment of the lofted material generally represented by reference numeral 30. In this disclosure, the term lofted material 30 includes foam and circularly knitted and/or warp knitted single ply materials that can be a variety of materials or combination of materials (batting, spacer fabric, etc.). Spacer fabric could be a polyester and/or nylon fabric. Lofted material 30 has a inner side or first side 31*a* that contacts the skin of the wearer and an outer side or second side 31*b* that faces in an outward direction opposite inner side 31. Lofted material 30 is sized to form an average or deep breast-receiving cup for a brassiere after being molded. Lofted material 30 has a loft 33 associated therewith.

Figure 2:
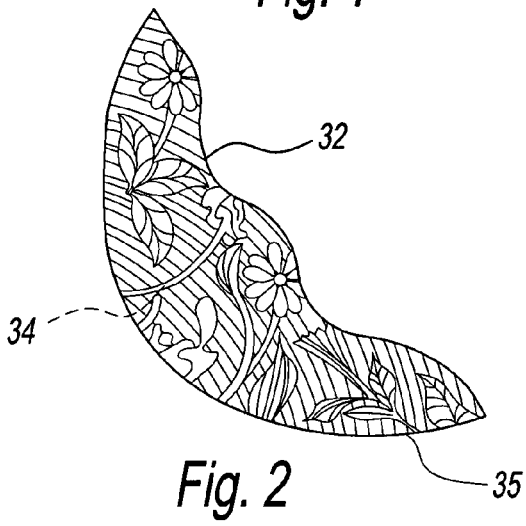
FIG. 2 is a top view of the pre-cut decorative support layer that is to be laminated to the lofted material in accordance with the present invention.

Referring to FIG. 2, support layer 35 is shown. Support layer 35 is cut in the shape of a crescent to ensure a comfortable and close fit at the lower lateral inner surface portion of the finished breast-receiving cup. Although the shape of support layer 35 is shown as a crescent with a curved edge, other shapes capable of offering comfort and support to the wearer could also be used. Support layer 35 can be any synthetic material or a natural material. Preferably, the support layer 35 is made of a warp knit material. In all instances, support layer 35 provides the level of comfort and support to the breasts of the wearer that would otherwise not be available without the enhanced support. Support layer 35 has a decorative pattern 32 thereon.

Figure 3:
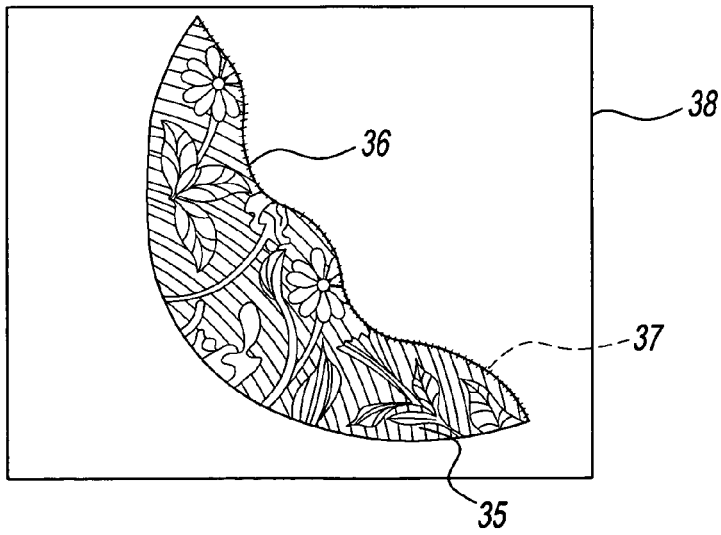
FIG. 3 is top view of the laminated assembly of lofted material sewn to the decorative support layer in accordance with the present invention.

In FIG. 3, support layer 35 that has an inner side is prepositioned on lofted material 30 on outer side 33, and the support layer and lofted material are secured, and preferably, sewn together using a multifilar yarn to form a curvilinear seam 36. By securing, and preferably, sewing the lofted material 30 and the support layer 35, their relative position is fixed prior to the molding and lamination step to prevent any slipping. Further, seam 36 provides aesthetic appeal by providing a contour across the breast-receiving cup.

Support layer 35 preferably has a layer of adhesive 37 applied to the inner side 34 to secure it against lofted material 30. Adhesive layer 37 is applied to support layer in a heating process before layer 35 is laminated to lofted material 30. Adhesive 37 is a heat-activated glue that can be a film, a web or polyester. The temperature that is required to activate adhesive 37 and laminate support layer 30 to mold lofted assembly 38 is approximately 320° F. to 360° F. The lamination process is of a temperature that will preserve the loft of lofted material 30, as well as the aesthetic appeal of the lofted material 30 and support layer 35.

Figure 4:
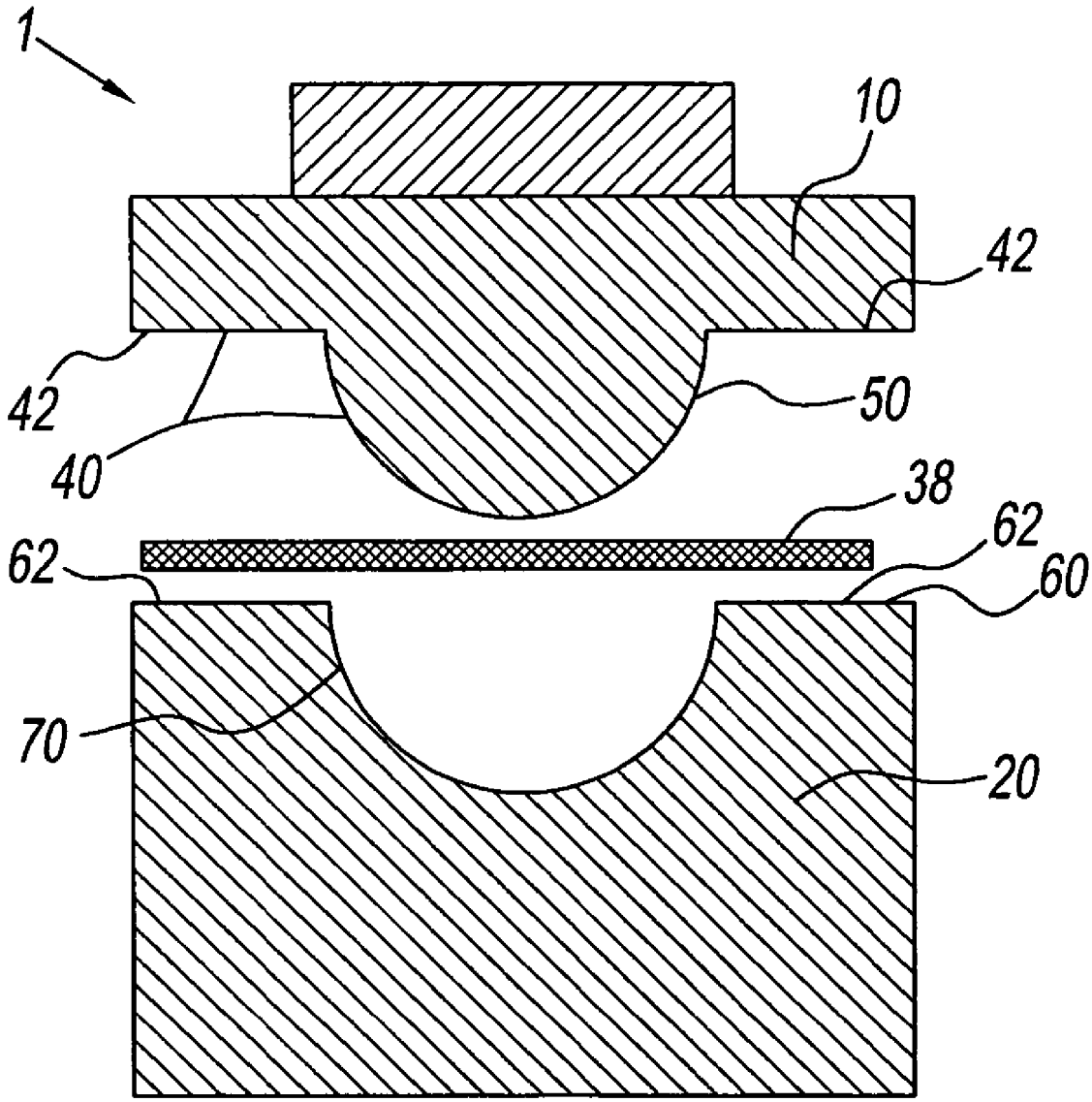
FIG. 4 is a cross-sectional side view of an apparatus for molding a lofted assembly in accordance with an illustrative embodiment of the present invention with the apparatus shown in open position.

FIG. 4 shows an illustrative embodiment of an apparatus 1 for molding lofted assembly 38. The apparatus 1 preferably has at least two mold elements, a first mold 10 and a second mold 20. Preferably, the first mold 10 and the second mold 20 are complementary to one another.

Preferably, first mold 10 and second mold 20 cooperate to mold or form lofted assembly 38 positioned therebetween into a three-dimensional shape, such as, for example, that required by molded brassiere pads or cups. Preferably, lofted assembly 38 can be any of a variety of materials or combination of materials and can be fashioned into a variety of forms, such as for example, a garment.

Figure 9:
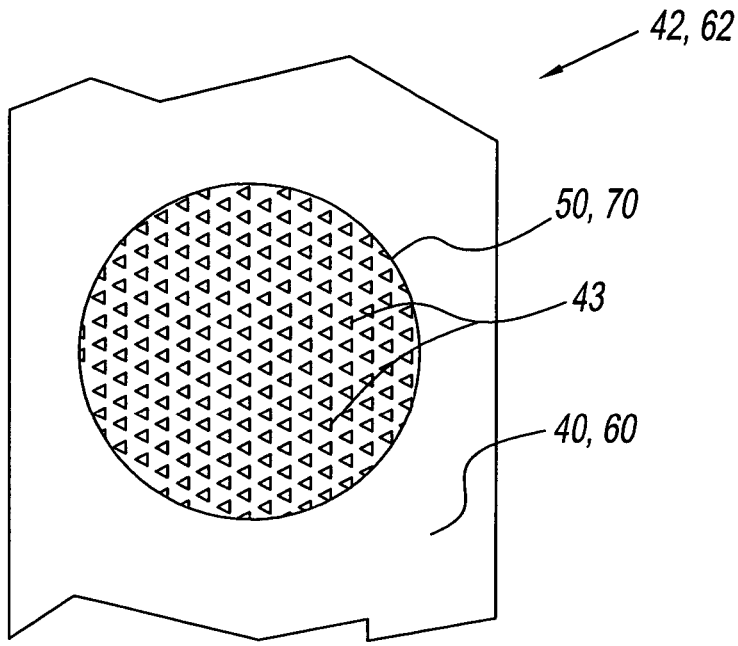
FIG. 9 is a plan view of a fourth embodiment of an apparatus for molding a lofted assembly according to the present invention.
Figure 10:
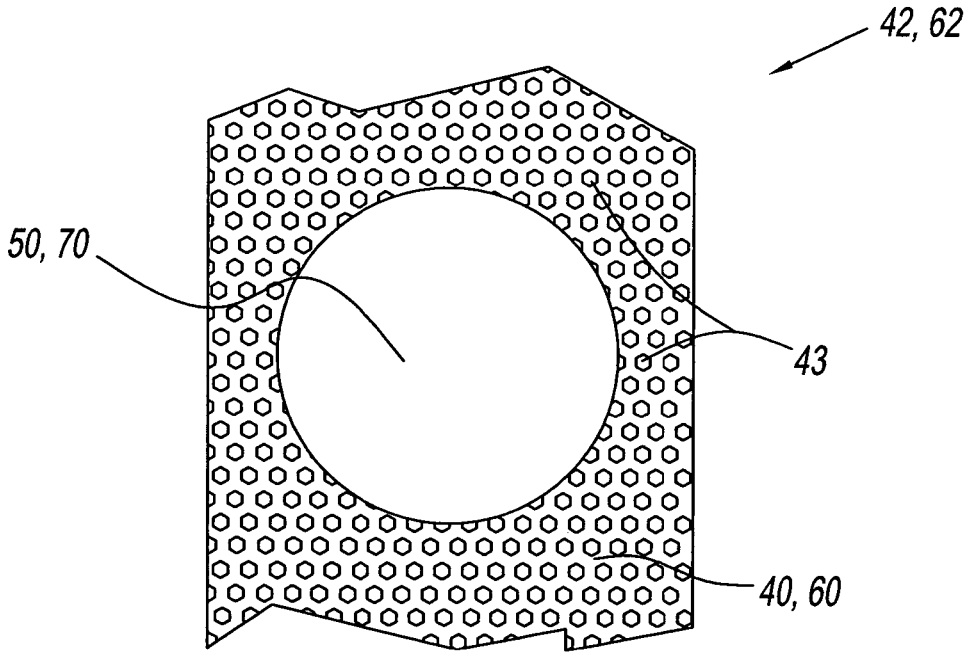
FIG. 10 is a plan view of a fifth embodiment of an apparatus for molding a lofted assembly according to the present invention.
Figure 11:
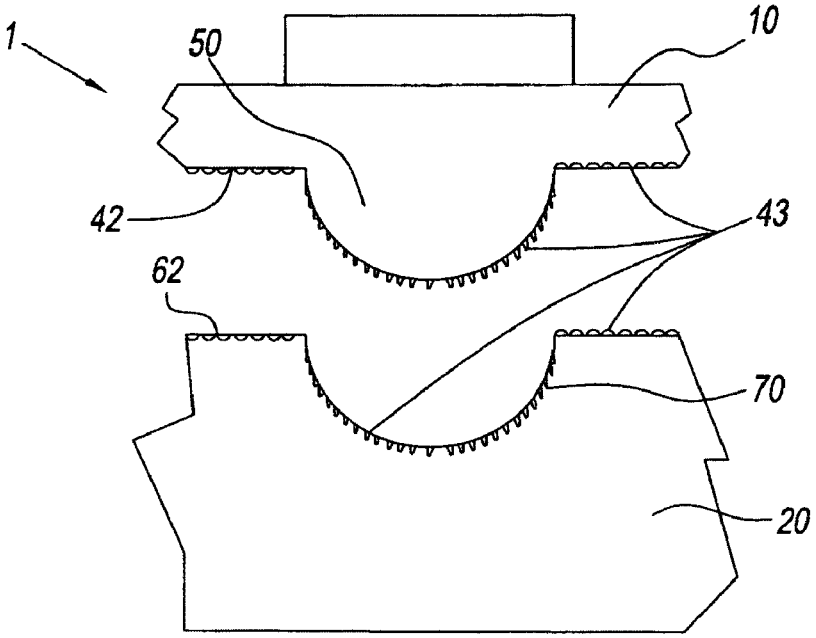
FIG. 11 is a side sectional view a sixth embodiment of an apparatus for molding a lofted assembly according to the present invention.

First mold 10 preferably has at least one first contact surface 40 with at least one projecting element 50 in the form of a dome. First contact surface 40 preferably also has a first level portion 42 about projecting element 50. First contact surface 40 may also have any of a variety of other surface elements 43 associated therewith, such as for example, one or more nodes, dimples, and/or teeth as shown in FIGS. 9 through 11.

First contact surface 40 can be interchangeably associated with first mold 10. First mold 10 can be interchangeably associated with apparatus 1. The interchangeability of first contact surface 40 and/or first mold 10 preferably provides apparatus 1 with further diversity in application or use.

Figure 7:
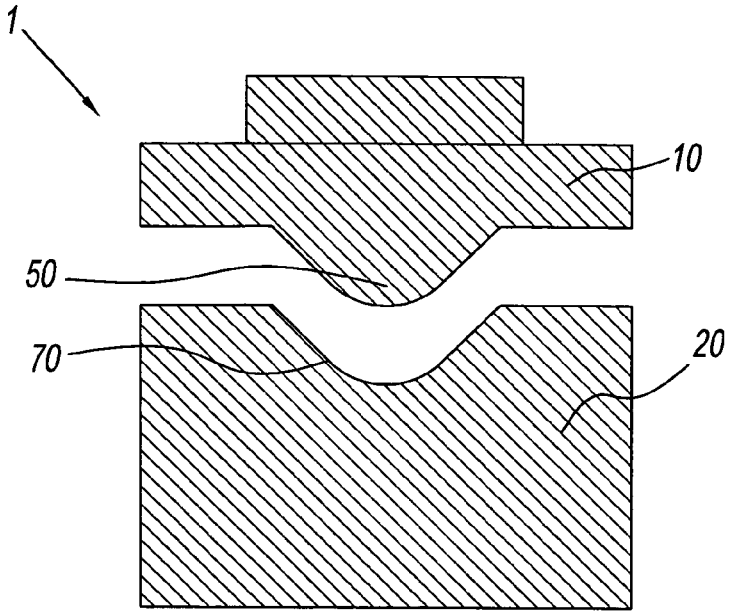
FIG. 7 is a side sectional view of a second embodiment of an apparatus for molding a lofted assembly according to the present invention.
Figure 8:
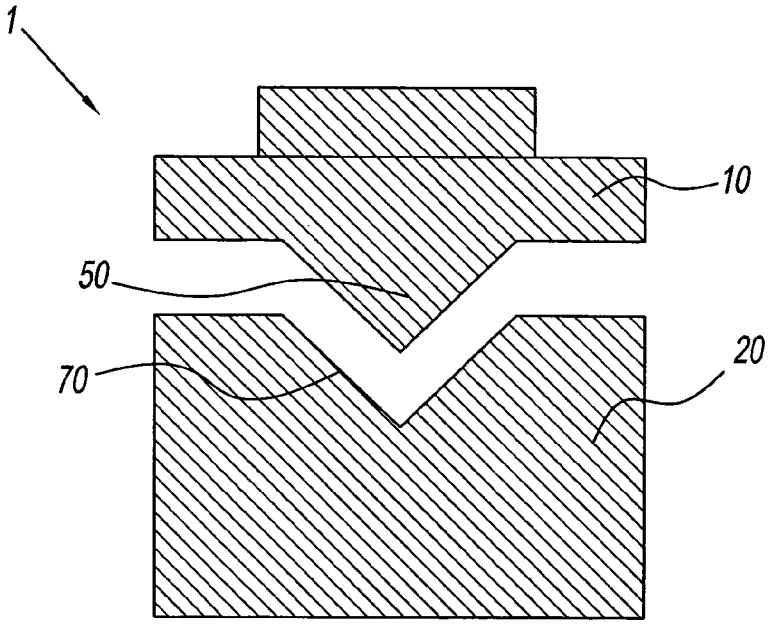
FIG. 8 is a side sectional view of third embodiment of an apparatus for molding a lofted assembly according to the present invention.

Preferably, first mold 10, first contact surface 40, projecting element 50, and/or first level portion 42 can be heatable. This heating can be accomplished in any of a variety of ways, such as for example, via electric heating wires or rods associated with first mold 10. These heating wires or rods could preferably conduct or transmit heat, via first mold 10, as appropriate, to provide any and/or all of the aforementioned elements thereof with sufficient heat for effective molding under a variety of different molding parameters. First mold 10 can preferably have any shape, size, and/or configuration suitable for accomplishing one or more different molding operations. See, for example, FIGS. 7 and 8, which show alternative embodiments of first mold 10. It is noted that the present invention is not limited to those configurations discussed and/or shown and that other configurations are also within the scope of the present invention.

It is also noted, with regard to surface elements 43 discussed above, that surface elements 43 are preferably suitable for achieving a variety of different molding effects. For example, surface elements 43 can be on either and/or both projecting element 50 and first level portion 42 to interact with lofted assembly 38 during a molding process. Surface elements 43 can be, for example, one or more piercing elements, heating or cooling elements, cushioning or insulating elements, or any combination of the same. Other similar types of elements may also be used and are within the scope of the present invention.

Referring again to FIG. 4, second mold 20 has at least one second contact surface 60 with at least one recessed element 70 in the form of a dish. Preferably, recessed element 70 is complementary to and cooperative with projecting element 50 of first mold 10. Second contact surface 60 preferably also has a second level portion 62 about recessed element 70. Second contact surface 60 may also have surface elements 43 associated therewith. Second contact surface 60 can be interchangeably associated with second mold 20, and, the second mold can be interchangeably associated with apparatus 1. The interchangeability of second contact surface 60 and/or second mold 20 preferably provides apparatus 1 with further diversity in application or use.

Preferably, second mold 20, second contact surface 60, recessed element 70, and/or second level portion 62 can be heatable. Such heating can be accomplished in any of a variety of ways, such as, for example, by electric heating wires or rods associated with second mold 20. These heating wires or rods could preferably conduct or transmit heat, via second mold 20, as appropriate to provide any and/or all of the aforementioned elements thereof with sufficient heat for effective molding under a variety of different molding parameters. Second mold 20 can preferably have any shape, size, and/or configuration suitable for accomplishing one or more different molding operations in cooperation with mold 10. See, for example, FIGS. 7 and 8, which show different embodiments of second mold 20. It is noted that the present invention is not limited to those configurations discussed and/or shown and that other configurations are also within the scope of the present invention.

As with the first mold 10, surface elements 43 provide a variety of different molding effects that can be on either and/or both recessed element 70 and second level portion 62 to interact with lofted assembly 38 during the molding process.

Figure 5:
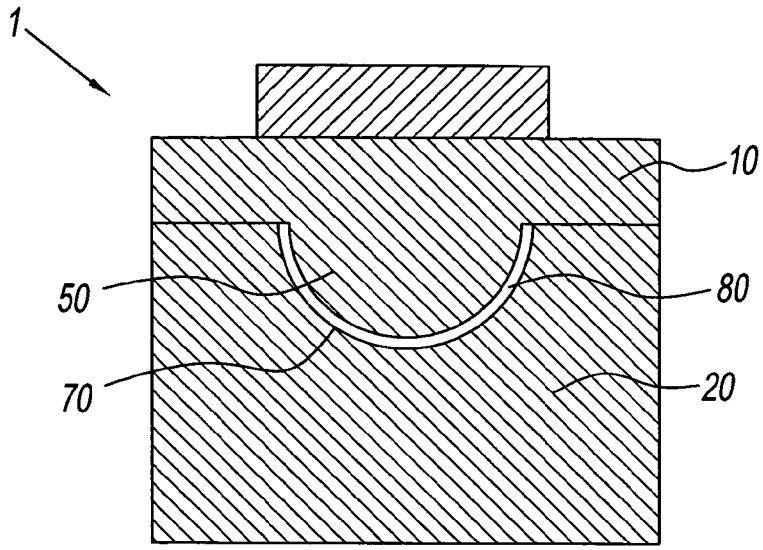
FIG. 5 is a cross-sectional side view of the apparatus of FIG. 4 with the apparatus shown in a closed position.
Figure 6:
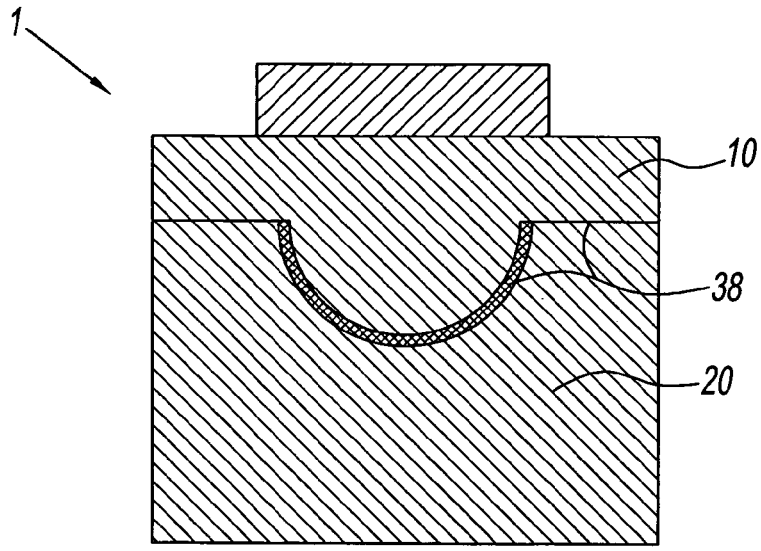
FIG. 6 is a side sectional view of the apparatus of FIG. 4, reflecting a forming step in accordance with an illustrative embodiment of the present invention.

Referring to FIGS. 5 and 6, having described some of the preferred elements of an illustrative embodiment of the present invention, first and second molds 10, 20, respectively, are preferably configured to engage one another such that when first level portion 42 of first mold 10 and second level portion 62 of second mold 20 are brought into relatively close relation, a uniform preset distance or gap 80 is created between projecting element 50 and recessed element 70. Gap 80 preferably has an extent of about 0.1 inches. However, gap 80 can also have any extent appropriate for accomplishing a desired molding operation. Hence, gap 80 can preferably be adjusted to accommodate the loft characteristics associated with a variety of different materials. This adjusting feature can be accomplished in different ways, such as, for example, via the preferred interchangeability of first and second molds 10, 20 and/or first and second contacting surfaces 42, 62. Gap 80 may also be adjusted to influence the degree of loft associated with a material. That is, gap 80 can be reduced to provide a desired finish or effect to lofted assembly 38. Thus, it is apparent the preservation of the inherent loft characteristics associated with a lofted assembly is preferably independent of the heat, pressure and/or time associated with a particular molding process. The present invention efficiently and effectively preserves the inherent loft characteristics associated with a lofted assembly during the molding process.

The process of molding lofted assembly 38 preferably includes at least the following steps. Referring to FIGS. 1 and 4 through 6, lofted assembly 38 is first positioned in apparatus 1 between first mold 10 and second mold 20. Lofted assembly 38 is positioned in apparatus 1 such that inner side faces projecting element 50, shown in FIG. 4. On lofted assembly 38, support layer 35 is sewn so that after the molding process, support layer 35 will be positioned at the lower lateral inner side edge of lofted assembly 38. Referring to FIGS. 5 and 6, first mold 10 is then closed in relation to second mold 20, or vice-versa, or the molds are each moved towards each other to sandwich lofted assembly 36 therebetween. Preferably, at least a portion of lofted material 30 is situated in gap 80 so that the inherent loft characteristics thereof are substantially preserved while at least another portion of lofted assembly 38 is substantially compressed between first and second level portions 42, 62 of first and second contact surfaces 40, 60, respectfully. Next, first mold 10 is opened in relation to second mold 20, or vice-versa, or the molds are each moved towards each other after an appropriate amount of heat and/or pressure has been applied for an appropriate period of time.

Figure 12:
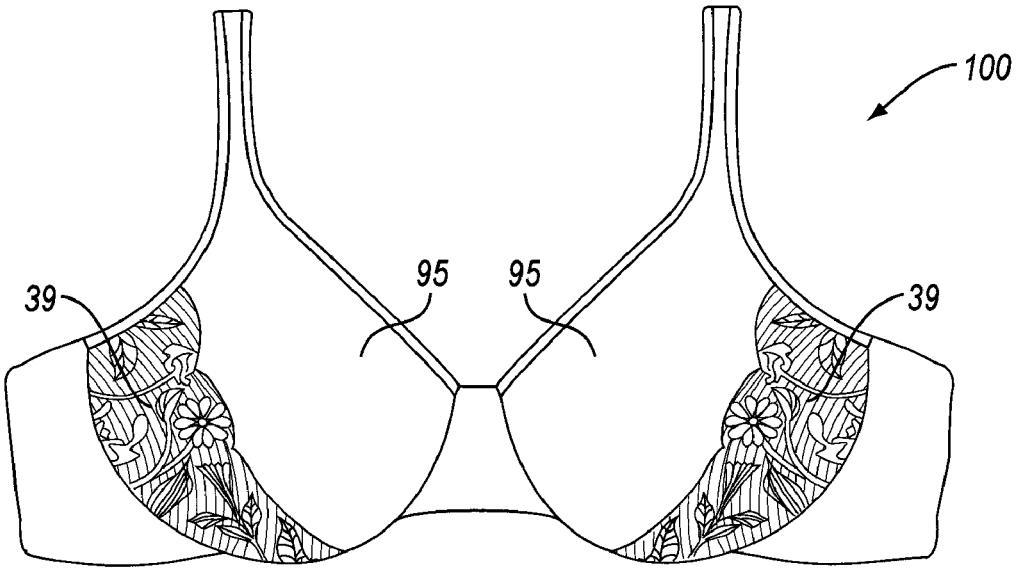
FIG. 12 is a front view of a brassiere with the lofted assembly molded in the form of breast-receiving cups having decorative support panels.

Referring to FIG. 12, a finished brassiere 100 with molded cups 95 is shown. Cups 95 have a decorative support layer 39 connected at a lower lateral edge. Layer 39 is preferably crescent shaped. Layer 39 is preferably lace, although other materials such as Jacquard, woven or knitted materials could also be used. Layer 39 is preferably decorative and can have any design such as, for example, a floral design or a geometric pattern.

The molding process of cup 95 results in a molded cup for a brassiere that accommodates wearers needing from average to large sized brassieres. Such a brassiere may include such conventional elements as side panels connected to one of a pair of breast receiving cups and shoulder straps connected to a separate one of a pair of breast receiving cups. The material of support layer 35 is of such stitch pattern and material that it limits the elasticity of the lofted material 30 from which cup 95 is made. The material is preferably a non-elasticized material that is knitted using a short stitch pattern. By limiting the elasticity in the material and using a shorter stitch pattern, the material of support layer will be less likely to stretch than an elasticized material of a longer stitch pattern. The material of support layer 35 will thus provide more rigid support and firm support. For wearers that require substantial breast support and for those that desire more support, breast cup 95 with comfort and confidence.

The present invention having been thus described with particular reference to the preferred forms thereof, it will be obvious that various changes and modifications may be made therein without departing from the spirit and scope of the present invention as defined herein.

What is claimed is:

1. A molded breast covering garment comprising:

a lofted material layer having an inner side for wear adjacent the breast, and an outer side opposite said inner side; and a support layer secured to said outer side of said lofted material, wherein said support layer is laminated to said outer side of said lofted material layer, and molded to form a breast-receiving cup with the support layer positioned only at a lower lateral portion and comprising the outermost layer of the breast-receiving cup.

2. The molded garment of claim 1, wherein said support layer is crescent shaped.

3. The molded garment of claim 1, wherein said support layer is sewn to said outer side of said lofted material.

4. The molded garment of claim 1, wherein said support layer has an adhesive film laminated thereon.

5. The molded garment of claim 1, wherein said support layer is sewn to said lofted material to form a pattern.

6. The molded garment of claim 1, wherein said support layer is decorative.

7. The molded garment of claim 1, wherein said support layer is selected from the group consisting of a synthetic fabric, a natural fabric, and combinations thereof.

8. The molded garment of claim 1, wherein said support layer is warp knitted.

9. The molded garment of claim 1, wherein said lofted material is selected from the group consisting of foam, spacer fabric, and circularly knitted and/or warp knitted single ply materials.

10. The molded garment of claim 1, wherein said support layer is selected from the materials consisting of woven material, lace, knit, and Jacquard material.

11. The molded garment of claim 5, wherein said pattern is a curvilinear pattern.

12. The molded garment of claim 1, wherein said garment comprises a brassiere.

13. A brassiere comprising:

a pair of breast receiving cups, each of said pair of breast-receiving cups being molded;

each of said pair of breast-receiving cups having a lofted material layer and a support layer, the lofted material layer having an inner side for wear adjacent the breast, and an outer side, the support layer being laminated to the outer side and positioned only at a lower lateral portion and comprising the outermost layer of each breast-receiving cup;

a pair of side panels, each of said pair of side panels being connected to a separate one of said pair of breast-receiving cups; and a pair of shoulder straps, each of said pair of shoulder straps being connected to a separate one of said pair of breast-receiving cups.

14. The brassiere of claim 13, wherein said support layer is crescent shaped.

15. The brassiere of claim 13, wherein said support layer is sewn to said lofted material to form a curvilinear seam.

16. The brassiere of claim 13, wherein said lofted material is selected from the group consisting of foam, spacer fabric, and circularly knitted and/or warp knitted single ply materials.

* * * * *